US006579504B1

(12) United States Patent
Liddell

(10) Patent No.: US 6,579,504 B1
(45) Date of Patent: Jun. 17, 2003

(54) HYDROMETALLURGICAL TREATMENT PROCESS FOR EXTRACTION OF PLATINUM GROUP METALS OBVIATING THE MATTE SMELTING PROCESS

(76) Inventor: Keith Stuart Liddell, Forrest Centre, Level 28, 221 St George's Terrace, Perth, Western Australia, 6000 (AU)

( * ) Notice: Subject to any disclaimer, the term of this patent is extended or adjusted under 35 U.S.C. 154(b) by 0 days.

(21) Appl. No.: 09/700,595

(22) PCT Filed: May 19, 1999

(86) PCT No.: PCT/IB99/00898

§ 371 (c)(1),
(2), (4) Date: Jan. 12, 2001

(87) PCT Pub. No.: WO99/60178

PCT Pub. Date: Nov. 25, 1999

(30) Foreign Application Priority Data

May 19, 1998 (ZA) ..... 98/4212

(51) Int. Cl.[7] ..... C22B 11/00
(52) U.S. Cl. ..... 423/22
(58) Field of Search ..... 423/22; 75/744

(56) References Cited

U.S. PATENT DOCUMENTS 4,108,639 A 8/1978 Lake et al. ..... 75/101 R
5,238,662 A 8/1993 Dubrovsky ..... 423/27
5,292,490 A * 3/1994 Duyvesteyn et al. ..... 423/22
5,364,444 A 11/1994 McDoulett, Jr. et al. ..... 75/421

FOREIGN PATENT DOCUMENTS

GB 1078453 8/1967
JP 56-013445 * 2/1981

OTHER PUBLICATIONS

"Hydrometallurgy of Precious Metals Recovery"; Fleming; Hydrometallurgy; vol. 30, No. 1/03; Jun. 1, 1992; pp. 127–162.

* cited by examiner

*Primary Examiner*—Steven Bos
(74) *Attorney, Agent, or Firm*—Roylance, Abrams, Berdo & Goodman, L.L.P.

(57) ABSTRACT

A hydrometallurgical treatment process for extracting platinum group metals from a flotation concentrate in which the invention revolves around obviating the matte smelting and granulating process. Instead the concentrate is submitted to pressure leaching, oxidative or reductive roasting and final recovery by means of ion exchange adsorption. Roasting is applied in order to convert the platinum group metals to a form that dissolves in chlorine/HCL and a chlorine/HCL leach that renders the platinum group metals in solution.

14 Claims, 5 Drawing Sheets

| CHEMICAL COMPOSITION OF THE SAMPLE | | | |
|---|---|---|---|
| MACROELEMENTS CONTENT, % | | NOBLE METALS CONTENT, gr/t | |
| Ni | 3.11 | Pt | 572 |
| Cu | 2.07 | Pd | 289 |
| Co | 0.073 | Rh | 106 |
| Fe | 12.4 | Ru | 155 |
| S | 7.09 | Ir | 39 |
| Si | 18.0 | Au | 5.6 |
| Cr | 1.22 | Ag | 17.4 |
| Mg | 9.45 | | |

FIG. 2

TEST RESULTS ON THE LEACHING OF CONCENTRATE SAMPLE
LEACHING TERMS: TEMPERATURE 150°C, OXYGEN PRESSURE 1MPa, SPEED OF MIXER ROTATION 2800 $MIN^{-1}$

| TEST'S NUMBER | $H_2SO_4$ CONSUMPTION % OF SOLID | LIQUID: SOLID | TIME, MIN | pH | cH, + mV | CONTENTS IN SOLUTION, g/l | | | CONSUMPTION OF SOLID, % | | RECOVERY INTO SOLUTION1, % | | FILTRATION RATES |
|---|---|---|---|---|---|---|---|---|---|---|---|---|---|
| | | | | | | Ni | Cu | Fe | Ni | Cu | Ni | Cu | kg/m2h |
| 1 | 2 | 3 | 4 | 5 | 6 | 7 | 8 | 9 | 10 | 11 | 12 | 13 | 14 |
| 28 | 38 | 3,1 | 40<br>80<br>120 | 0,5<br>0,45<br>0,5 | 675<br>715<br>730 | 8,2<br>9,5<br>9,8 | 0,05<br>3,4<br>4,0 | 30,4<br>11,3<br>11,2 | 2,26<br>0,063<br>0,052 | 2,88<br>1,72<br>0,77 | 44,9<br>98,5<br>98,7 | 0<br>37<br>71,8 | |
| 22 | 30 | 3 | 40<br>80<br>120 | 0,8<br>0,85<br>0,85 | 660<br>690<br>710 | 6,7<br>7,0<br>8,1 | 1,9<br>2,6<br>3,5 | 7,1<br><br>5,3 | 1,46<br>0,057<br>0,05 | 2,38<br>1,34<br>0,36 | 72,5<br>98,9<br>99,1 | 32,7<br>62,5<br>89,9 | |
| 29 | 23 | 3 | 40<br>80<br>120 | 0,85<br>0,9<br>0,95 | 635<br>680<br>710 | 6,3<br>7,7<br>7,2 | 1,7<br>3,2<br>3,2 | 8,4<br>4,6<br>2,7 | 2,94<br>0,052<br>0,048 | 2,5<br>1,13<br>0,34 | 55,8<br>99,2<br>99,3 | 43,6<br>74,5<br>92,3 | |
| 30 | 15 | 3 | 40<br>80<br>120 | 0,8<br>0,8<br>0,85 | 655<br>665<br>705 | 9,7<br>10,1<br>10,9 | 2,9<br>4,3<br>5,6 | 3<br>1,7<br>1,7 | 0,14<br>0,062<br>0,085 | 1,14<br>0,84<br>0,78 | 96,3<br>98,3<br>97,7 | 55,1<br>67,2<br>69,3 | |
| 33 | 7,5 | 3 | 40<br>80 | 1,1<br>1,25 | 645<br>615 | 6,9<br>7,7 | 2,0<br>2,2 | 1,1<br>0,59 | 0,15<br>0,11 | 0,86<br>0,8 | 95,6<br>96,8 | 62,8<br>65,2 | |
| 34 | 3,1 | 3 | 40<br>80<br>120 | 1,25<br>1,3<br>1,2 | 655<br>635<br>685 | 6,1<br>5,8<br>7,4 | 1,9<br>2,4<br>4,0 | 0,6<br>0,44<br>0,6 | 0,24<br>0,12<br>0,21 | 0,92<br>0,56<br>0,54 | 93,4<br>96,75<br>94,25 | 62,3<br>76,9<br>77,8 | |
| 35 | 3 | 3 | 40<br>80 | 1,05<br>1,0 | 685<br>695 | 8,9<br>10 | 2,7<br>5,2 | 0,59<br>0,47 | 0,32<br>0,13 | 1,11<br>0,58 | 91,2<br>96,4 | 53,9<br>75,9 | 8,15 |
| 38 | 0 | 3 | 40<br>80<br>120 | 1,1<br>1,1<br>1,15 | 680<br>690<br>690 | 9,5<br>10,3<br>10,3 | 3,0<br>4,6<br>6,0 | 0,4<br>0,33<br>0,47 | 0,24<br>0,2<br>0,13 | 0,84<br>0,49<br>0,26 | 93,4<br>94,5<br>96,4 | 65,1<br>79,6<br>89,2 | |

FIG. 3

| 1 | 2 | 3 | 4 | 5 | 6 | 7 | 8 | 9 | 10 | 11 | 12 | 13 | 14 |
|---|---|---|---|---|---|---|---|---|---|---|---|---|---|
| 37 | 0 | 2 | 40<br>80<br>120 | 0,95<br>0,95<br>1,0 | 675<br>680<br>690 | 14,7<br>14,5<br>15,1 | 3,8<br>5,6<br>7,4 | 0,27<br>0,59<br>0,58 | 0,22<br>0,16<br>0,14 | 0,95<br>0,76<br>0,51 | 93,9<br>95,6<br>96,1 | 60,5<br>68,4<br>78,8 | |
| 40 | 0 | 3 | 85 | 1,15 | 660 | 9,2 | 4,2 | 0,67 | 0,15 | 0,54 | 95,9 | 77,6 | |
| 41 | 0 | 3 | 95 | 1,15 | 685 | 10,2 | 4,6 | 0,31 | 0,16 | 0,65 | 95,4 | 72,1 | |

FIG. 3A

HYDROMETALLURGICAL TREATMENT PROCESS FOR EXTRACTION OF PLATINUM GROUP METALS OBVIATING THE MATTE SMELTING PROCESS

BACKGROUND TO THE INVENTION

This invention relates to the hydrometallurgical treatment process for extracting platinum group metals from a flotation concentrate.

Conventionally, platinum group metals are extracted from a flotation concentrate in a matte smelting and converting process followed by further refining for the extraction of the platinum group metals.

SUMMARY OF THE INVENTION

According to the invention there is provided a hydrometallurgical treatment process for extracting platinum group metals from a flotation concentrate comprising the steps of:

- leaching of the flotation concentrate to dissolve base metal sulphides in the flotation concentrate so as to form a filtrate and a residue;
- separation of the filtrate from the residue;
- roasting the residue to form a calcine; and
- chlorination of the calcine to dissolve the platinum group metals into solution.

Typically, the process includes the additional steps of:

- adsorption of the platinum group metals onto an ion exchange resin; and
- recovery of the platinum group metals from the ion exchange resin.

Preferably, the roasting step involves oxidation or reduction, more preferably oxidation at up to 1000° C.

Typically, the method includes the step of recovering Osmium from the off-gas from the roasting step.

The chlorination step preferably comprises countercurrent chlorination of the calcine at approximately 80° C. and 3.5N HCl.

The separation step typically comprises filtration followed by the additional steps of neutralisation of the filtrate; precipitation of base metal sulphides and flotation of precipitated sulphides into a concentrate.

The step involving adsorption of the platinum group metals onto an ion exchange resin may be followed by:

- desorption of the platinum group metals from the resin with thiourea at approximately 80° C. followed by water washing of the stripped resin; and/or
- precipitation of the platinum group metals from the eluate with caustic solution.

Various embodiments of the invention are described in detail in the following passages of the specification which refer to the accompanying drawings. The drawings, however, are merely illustrative of how the invention might be put into effect, so that the specific form and arrangement of the features shown is not to be understood as limiting on the invention.

BRIEF DESCRIPTION OF THE ACCOMPANYING DRAWINGS

FIG. 2 is a table which sets out the composition of a flotation concentrate which is used to describe the first embodiment of the method of the invention;

Figure 4:
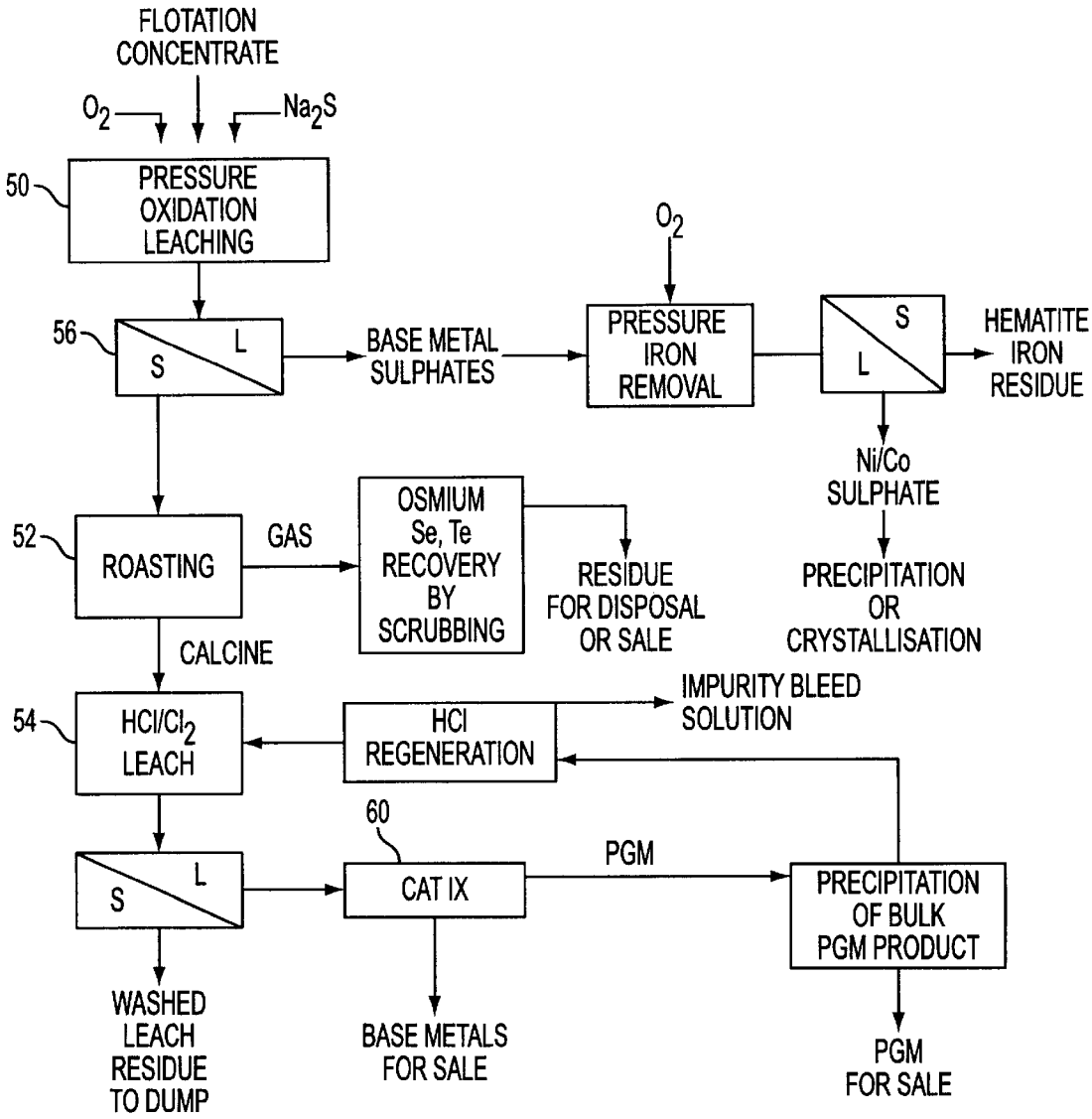

FIG. 3 and FIG. 3A comprises two tables setting out the results achieved in experimental work on the autoclave oxidative leaching of a sample of flotation concentrate; and FIG. 4 is a diagrammatic flow sheet of a second embodiment of the hydrometallurgical extraction process of the invention.

DESCRIPTION OF AN EMBODIMENT

Figure 1:
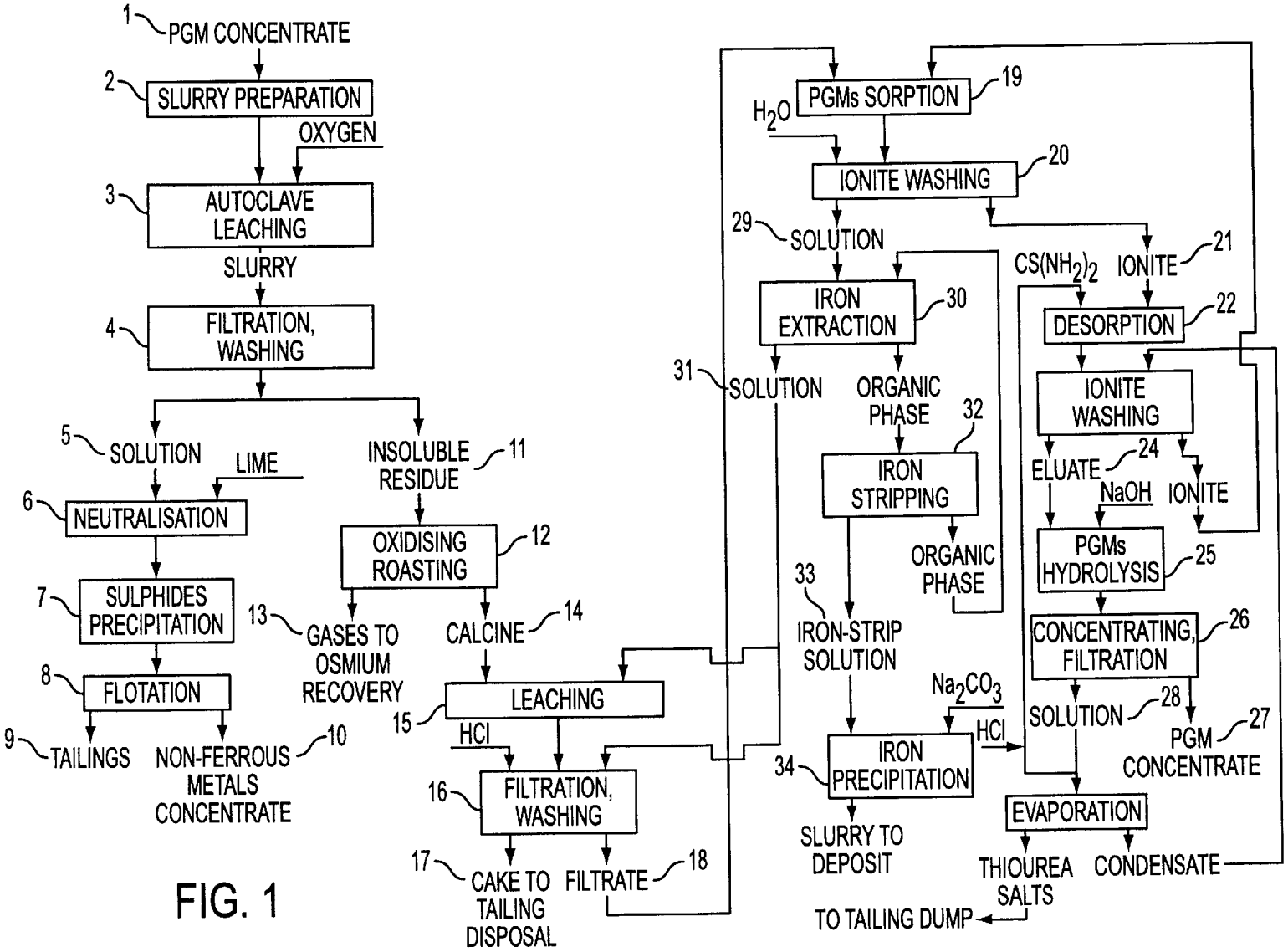
FIG. 1 is a diagrammatic flow sheet of a first embodiment of the hydrometallurgical extraction process of the invention.

FIG. 1 of the accompanying drawing depicts diagrammatically a first embodiment of the hydrometallurgical treatment process according to the invention for extracting platinum group metals from a flotation concentrate. In broad outline the proposed process comprises the following unit operations:

- autoclave oxidative leaching of the concentrate to dissolve the base metal sulphides;
- filtration of the oxidised slurry;
- neutralisation of the filtrate and precipitation of base metal sulphides with lime/sulphur, followed by flotation of the precipitated sulphides into a concentrate;
- oxidative roasting of the residue;
- scrubbing of the off-gas from the roaster for Os recovery;
- countercurrent chlorination of the calcine which is the product of the roasting step;
- cooling and filtration of the chlorinated slurry with washing of the filter cake;
- disposal of the washed residue;
- adsorption of the platinum group metals from the filtrate onto an ion exchange resin;
- desorption of the platinum group metals from the resin with thiourea followed by water washing of the stripped resin;
- precipitation of platinum group metals from the eluate with caustic solution;
- thickening and filtration of the platinum group metal precipitate; and
- removal of iron from the resin washing solution by solvent extraction with a tertiary amine, the iron and other base metals being stripped from the extractant with water and then precipitated with soda ash.

The process will now be described in greater detail with reference to the accompanying drawings and tables.

In order to illustrate the first embodiment of the invention a flotation concentrate is used having a composition as is set out in FIG. 2. The platinum group metal flotation concentrate is introduced into the process as feed 1. The feed prepared as a slurry 2 is subjected to autoclave leaching 3 in order to dissolve, at least partially, base metals such as Ni, Cu, Co and Fe. This is done prior to the leaching of the platinum group metals from the concentrate so as to remove the base metals from the process and thereby simplify the recovery of the platinum group metals.

Any iron which remains in the solid phase, mainly in the hydrated form, would have a negative influence on the results of further stages such as calcination, chlorination or adsorption. A process which may be implemented to assist with the removal of iron at the initial stage is to pre-treat the initial concentrate with sulphuric acid in an autoclave without the presence of an oxidiser such as oxygen. Without the properly chosen process parameters sulfide iron, present in the form of pyrrhotite, pentlanddite and chalcopyrite, decompose and transfer to the solution in the form of $FeSO_4$.

The dissolution of the base metals is standard technology and is typically done by oxidation under pressure in an autoclave, at an oxygen pressure of 1.0 MPa, a liquid to solid ratio in the flotation slurry of 3 and a temperature of 150° C. with a residence time of 1.5 hours.

Autoclave leaching also has the advantage of removing sulphur which is present in the concentrate. This is beneficial as it leads to reduced $SO_2$ handling in the subsequent roasting stage. Through experimental work it was found that the autoclave leaching of a platinum group metal flotation concentrate having a composition as is depicted in FIG. 2 and applying the aforementioned conditions results in desirable recovery of sulfides with a transfer of 93 to 96% of nickel and more than 70% of copper to the solution. Transition to the solution among platinum metals is found to be low, in the region of 2 to 2.5% of the quantity of metal in the initial concentrate. It was found that the degree of Pt and Pd dissolving was less than 0.5%.

FIG. 3 sets out the results that were achieved in the autoclave oxidative leaching of a concentrate sample having a chemical composition set out in FIG. 2. These experiments in leaching were carried out in 1 and 3 liter capacity autoclaves at a temperature of 150° C., partial oxygen pressure of 1 MPa, rotation speed of a turbine mixer @ 2800 $min^{-1}$, a liquids to solids ratio of between 2 and 3 and a process duration of 40 to 120 minutes. The results of the experimental work are presented in the table of FIG. 2. In this table only the consumption of Ni and Cu into solution are recorded.

From the results set out in table 2 of FIG. 2 and a series of other experimental work that was conducted on various concentrate samples the following mode of oxidizing leach was found to be desirable for oxidizing leaching of flotation concentrates with relatively high sulphur content:

temperature 150° C.

oxygen partial pressure 1 MPa process duration 60–80 minutes liquids to solids ratio 3.

It is important that in the base metal removal stage 3 the quantities of platinum group metals that are dissolved are kept to a minimum. Under the conditions specified above it has been found there is negligible dissolution of platinum group metals.

After base metal dissolution the resultant slurry is filtered 4, with the filtrate being processed to recover the base metals in steps 5,6,7,8,9 and 10 and the insoluble residue being processed to further concentrate and recover the platinum group metals. The slurry exiting the autoclave leaching stage is a finely dispersed product and is thus not ideal for thickening and filtration. Larox type filters have been found to be suitable for handling slurries of this sort owing to their compactness and possibility to conduct effective cake washing and drying in a single stage.

Through experimentation it has also been found that in order to assist with processing conditions downstream of the filtration stage 4 the moisture content of the cake eminating from the filtration stage should not be more than 13%. Accordingly, it is advisable to increase the duration of dewatering of the material in the filter until the desirable moisture content is achieved.

There are a number of different options which can be followed in the recovery of the base metals from the filtrate. In the embodiment of the invention depicted in FIG. 1 the filtrate is neutralised with lime 6 to a pH of approximately 4, followed by contacting the filtrate with a lime/sulphur slurry 7 at 150°C. $pO_2$ =1000 kPa, t=60–80 minutes, and liquid to solid ratio of 3:1 to precipitate the base metals as sulphides. In effect this is autoclave leaching of the base metals. These sulphides are then recovered by flotation as a mixed Ni, Cu, Co concentrate.

Other options which also exist for base metal recovery from the filtrate would include solvent extraction and precipitation with hydrogen sulphide.

The insoluble residue 11 containing the platinum group metals emanating from the filtration step 4 are passed to an oxidising roast 12 which in the described embodiment of the invention is performed at temperatures of 500 to 1000° C. Directly before roasting the material is mixed with lime and granulated. The addition of lime repeats the removal of sulphur to gasious phase 13 and the granulated material limits dust removal from the furnace. It is proposed to use a shaft furnace with the adjustment of heating mode by heating gases obtained by burning liquid or gas fuel.

Through experimentation it has been found that the oxidising roast results in approximately 85 to 93% of the Osmium present in the insoluble residue being removed to the gas phase. It was also found that along with the Osmium about 5% of Ruthenium passes to the gas phase. The recovery of Osmium is achieved in a scrubbing system by abadsorption. Gas eminating from the roasting stage containing sulphur and sulphuric anhydride in addition to Osmium tetraoxide is spread by recycling solutions in the absorbers. In this way the Osmium tetraoxide and sulphuric anhydride are removed from the gas. It is known to recover Osmium from the off-gas of a smelter according to known processes for the extraction of platinum group metals from a flotation concentrate. The advantage of the process of the invention over and above the known smelter process is that the volume of off-gas leaving the roaster is significantly less than from a smelter which allows for improved recovery of Osmium in the scrubbing process.

This oxidation roast produces calcines 14 which are chlorine leached at temperatures of 20 to 90° C. in step 15. A two stage chlorination is required to achieve high dissolutions of Pt (in excess of 96%) and Pd (in excess of 99%) from the calcine. In tests which were conducted on this process by the applicant it was found that Rh dissolution was low, typically approximately 13%. Nevertheless, it was found that Rh dissolution tends to increase with both increasing roasting and chlorination temperatures.

As a result of fulfilled investigations (stages 2, 3) a technology comprising two-stage calcination chlorination leaching with the counter-current flow of solid and liquid phases is proposed for industrial implementation. The process conditions (for each stage) are as follows: temperature 85–90° C.; L/S ratio—3–3.5; $[HC]_{initial}$=170 g/l; duration 2–2.5 hours and Redox-potential 950–1050 mV. provide the recovery from the cake after AOL (%): platinum 99, palladium 92, rhodium 84, ruthenium and iridium 90, gold 95. The aforementioned process parameters have been found to lead to the following percentage recoveries of the platinum group metals.

These recoveries can be increased, for example, by increasing each stage duration to 4 hours. However, this leads to the increase of iron content in the final solution to 20 and more g/l, that is undesirable as it interferes with later PGM adsorption from the solution.

During the additional research of the hydrochlorination—adsorption stages there were found two items, which have to be considered while the implementing of the technology.

It is envisaged that in place of an oxidising roast 12 a reductive roast could be conducted on the insoluble residue 11. A hydrocarbon source could be used as a reductant, which converts the platinum group metals to the metallic state. Such a reduction would typically be done at a temperature of 650° C. Based on tests which have been conducted by the applicant on the method of the invention it would seem that if the calcine is reduced, as opposed to being oxidised, lower roasting temperatures can be used.

The roasting temperature can also be lowered by subsequently forming a thermal reduction of the calcine prior to chlorination. It will be appreciated that this would introduce an additional stage into the process.

The chlorinated slurry emanating from the leaching step 15 is cooled and filtered 16. The filter cake is washed before disposal 17 of the residue which comprises the filter cake. The filtrate 18 from the filtration step is passed to an ion exchange adsorption unit 19 for extraction of the platinum group metals from the filtrate by adsorption onto ion exchange resins which are selective for platinum group metals, for example proprietary resins such as ROSSION 11 and ROSSION 70.

From the ion exchange adsorption stage 19 the resin onto which the platinum group metals have been adsorbed is passed through an ionite washing unit 20 before the resin 21 is passed to a desorption unit 22. Desorption of the platinum group metals is done with thiourea according to known technology as is depicted diagrammatically in unit operations 24, 25, 26 and 28 in the accompanying drawing. The use of thiourea may equally be replaced with another appropriately selected desorption chemical due to potential carcinogenic effects of thiourea.

An alternative to the fairly complex desorption stage 22 would be to burn the resin. Burning of the resin has environmental implications, but would result in a product containing approximately 80% platinum group metals in an unrefined state.

In the first embodiment of the invention the platinum group metals are stripped from the resin and then either precipitated, to form a concentrate 27 which can be further refined to the individual metal (Pt, Pd, Rh, Ru, Ir) sponges or salts.

The solution 29 from the washing unit 20 is passed through an iron extractor 30 to obtain a solution 31 that is fed to washing unit 16. An organic phase from iron extractor 30 is directed to an iron stripping process 32 to obtain a solution 33 which is fed to an iron precipitation tank 34.

FIG. 4 of the accompanying drawings depicts an alternative embodiment of the invention. In this embodiment the essence of the invention, namely the three steps of base metal recovery in a leach 50, roasting 52 to convert the platinum group metals to a form that dissolves in chlorine/HCl and the chlorine/HCl leach 54 that provides the platinum group metals in solution, are retained with changes to the ancillary features of the invention.

The most notable differences between the process proposed in this embodiment of the invention and that proposed above with reference to FIGS. 1, 2 and 3 is that the conditions of the pressure oxidative leaching of the base metals and sulphides 50 are set such that they dissolve as much of the base metals and sulphides as possible. This reduces the amount of Fe remaining in the solid phase, dissolving downstream in the $HCl/Cl_2$ leach of calcine and interfering with the ion-exchange recovery 60 of platinum group metals. It is therefore desirable to dissolve most of the iron during the pressure oxidative leach step 50, followed by a separation step 56 involving pressure oxidation to precipitate iron as haematite and thereby separate it from the dissolved copper and nickel. Iron is then removed from the dissolved copper and nickel by counter-current washing or filtration, and the copper and nickel recovered by precipitation as a bulk concentrate or by solvent extraction.

APPENDIX

PART 1

1. The PGMs concentrate
   Amount - 10,000 t/yr.
   The concentrate composition:

| Element | Content, % | Amount, tons | Element | Content, % | Amount, tons |
|---|---|---|---|---|---|
| Ni | 1.04 | 104 | Ti | 0.19 | 19 |
| Cu | 0.62 | 62 | Pt | 0.0156 | 1.56 |
| Co | 0.023 | 2.3 | Pd | 0.00747 | 0.747 |
| Fe | 7.9 | 790 | Rh | 0.00263 | 0.263 |
| S | 1.72 | 172 | Ru | 0.00527 | 0.527 |
| Mg | 9.3 | 930 | Ir | 0.000059 | 0.0059 |
| Ca | 2.3 | 230 | Au | 0.000191 | 0.0191 |
| Cr | 2.8 | 280 | Os | 0.00012 | 0.012 |
| SjO2 | 42.24 | 4224 | | | |
| Al | 3.25 | 325 | | | |

2. The slurry preparation:
   Liquid: solid ratio = 2
   The slurry is prepared in the reactor equipped with a stirrer, V - $4m^3$ material - steel 3.
3. The autoclave oxidising leaching:
   Process parameters:
   Temperature - 145 ± 5° C.
   Duration -2 hours
   Partial oxygen pressure - 0.5 MPa
   Total pressure - 1.0–1.1 MPa
   The autoclave needed the number of the sections - 4, the number of stirrers - 4, V = $10m^3$.
   Extraction into solution, in %:
   Ni - 75.0; Cu - 90; Co - 70; Fe - 40; Ca - 10.8; Mg - 7.25; S - 70.0
   Oxygen consumption - 300 t/yr.
   Sulphuric acid consumption - 900 t/y.
4. Filtration and washing
   Filtration rate - 0.3 $m^3/m^2$*hour
   Equipment - a filter with filtering area S = $10m^2$
   Insoluble residue is washed in the filtering area. Water consumption - 0.5 $m^3$/t of the residue.
   Output of the insoluble residue - 101% of initial.

APPENDIX-continued

5. Solution (filtrate) after autoclave leaching:
Amount - 22 500m$^3$/yr.
Composition, g/dm$^3$:
Ni - 3.47; Cu - 2.49; Co - 0.063; $Fe_{total}$ - 14.04; Ca - 1.1; Mg - 3.0; $H_2SO_4$ - 26.7
6. Neutralisation is carried out with lime (pH is adjusted up to 4) at 60–70° C. for 45 minutes.
Lime consumption - 1442 t/yr.
Lime activity - 90%
The lime slurry is prepared in a reactor (V - 0.2 m$^3$); water consumption - 1442 m$^3$/yr.

PART 2

7. Precipitation is carried out with lime-sulphur slurry (LSS) at 90° C. for 45 minutes. Extraction degree for nickel is 94–95%; copper - 99.5%; cobalt - 90%.
For obtaining of the LSS, the slurry with S: CaO: $H_2O$ ratio = 2:1:8 is heated up to 95° C. and maintained for 1 hour. Liquid phase of the LSS contains ($S_{mooo}$ $S_{thio}$) ~.75 g/dm$^3$.
To prepare the LSS a 0.25 m$^3$ reactor is required. Precipitation of sulphides is conducted in reactors with total volume of 5m$^3$.
Amount of solid phase - 3645 t/yr.
The solid phase composition, %:
Ni - 2.0 ± 0.02; Cu - 1.52 ± 0.02; Co - 0.04 ± 0.002; Fe - 8.3 ± 0.1; S - 3.45 ± 0.2;
Ca - 17.2 ± 0.2.
Volume of liquid phase - 24842 m$^3$/yr.
The liquid phase composition, g/dm$^3$:
Ni - 0.18; Co - 0.006; $Fe_{total}$ - 0.41; Ca - 1.1; Mg - 2.72; $H_2SO_4$ - 1.8.
Reagents consumption for the LSS preparation:
Lime (activity - 60%) - 112.5 t/y
Sulphur - 225 t/y
$H_2O$ - 900 m$^3$.
8. Flotation of slurry is accomplished in a flotation machine according to the scheme: basic flotation and retreatment of tailings. The performance of a flotation machine is 3.5 ± 0.25 m$^3$ of slurry per hour.
9. Tailings after flotation of non-ferrous metals contain:
The solid phase - 3115 t/y; liquid phase - 24313 m$^3$.
The solid phase contains, %:
Ni - 0.1; Cu - 0.04; Co - 0.001; Fe - 6.7; Ca - 19.8; S - 0.22
The liquid phase contains, %:
Ni - 0.22; Co - 0.002; Fe - 0.41; $H_2SO_4$ - 1.8; Ca - 1.1; Mg -2.74.
The tailings can be directed to the deposit area or after concentration up to liquid: solid ratio = 1:1, the concentrated slurry can be directed to the deposit area, while solution (21198 m$^3$/yr) - to the oxidising leaching.
10. Non-ferrous metals concentrate (amount - 529 t/y, moisture - 50%) containing, %:
Ni - 13.2; Cu - 10.4; Co -0.27; Fe - 18.5; Ca - 1.9; S - 22.5,
is directed to the processing for extraction of non-ferrous metals into a commercial product.
11. Insoluble residue after leaching.
Moisture - 20%; amount - 10100 t/y (dry weight).
The residue composition, %:
Ni - 0.26; Cu - 0.06; Co - 0.006; Fe - 4.69; Ca - 2.03; Mg - 8.54; S - 0.51. Platinum group metals do not actually pass into solution during leaching.
12. Oxidise roasting.
Oxidising temperature - 1000 ± 50° C.
Duration - 2 hours.
A tube furnace is required: diam. - 1.2 m, length - 22 m.
The furnace rotation speed - ω 0.6 rpm.
Electric motor capacity - W - 50 kW.
13. The off-gases (from the tube furnace) containing osmium are directed to scrubbing with the following osmium recovering into a commercial product by the known methods.
14. The roasted material after cooling up to 60-80° C. is directed to leaching for PGMs to be transferred into solution.
The roasted material yield is 100 ± 2% of the charge.
15. Leaching of the PGMs

PART 3

For the PGMs extraction into solution the roasted material is subject to countercurrent two-stage leaching.
The process parameters:
Temperature - 80° C.;
Duration of each stage - 8 hours;
solid: liquid ratio 1:1.5
The recycled solution of hydrochloric acid (3.5N) is utilised for leaching.
Chlorine consumption is 5 t/y.
Leaching is carried out in the reactors equipped with stirrers.
Total volume of the reactors - 50 m$^3$. Material - titanium alloys.
Extraction from the roasted material into solution, %:
Pt - 95.5; Pd - 98.0; Rh - 46.0; Au - 90.0; Ru - 65.0; Ir - 70.0; Fe - 9.3; Cu - 20.0; Ni - 20.0; Co - 6.0; Al - 8.0; Ca - 20.0.
16. Filtration and washing.
Filtration temperature - 20–30° C.
Filtration rate - 1.5 m$^3$/m$^{2-}$ hour
Filtering area - S = 2–2.5 m$^2$.
Washing of residue is conducted with the recycled solution of HCl (3.5N). The solution consumption - 1 m$^3$/t of the residue.

APPENDIX-continued

17. Output of washed residue (dry weight) is 98 ± 1% of the roasted material.
Moisture of the residue - 20%.
The residue (in amount of 9898 t/y) is directed to the deposit area.
The residue composition, %:
Ni - 0.21; Cu - 0.048; Fe - 4.34; Al - 3.02; Ca - 1.66; Mg - 8.71; Ti - 0.19; Co - 0.006; $SiO_2$ 42.68; S -0.01; Pt - 0.0007; Pd - 0.00015; Rh - 0.0014; Au - 0.000019; Ru - 0.0019; Ir - 0.000018.
18. Filtrate and sluice water are directed to PGMs sorption:
The amount of the solution - 23000 $m^3$/yr.
The solution composition, mg/$dm^3$:
Ni - 226; Cu - 52.5; Fe - 1913; Al. - 1130; Ca - 1763; Pt - 64.78; Pd - 31.83; Rh - 5.26; Au - 0.75; Ru - 14.9; Ir- 0.178.
19. Sorption of the PGMs is accomplished in three sorption columns (two of them are used for sorption the PGMs, the third one for desorption of the PGMs and washing).
Ionite Rossion 11 is used as a sorbent.
The sorbent capacity is 60 kg of the PGMs per 1 ton of the ionite.
The ionite swelling factor - 3.0.
Solution flow rate through the sorption columns 3 $m^3$/hour.
Three-column plant is acceptable; diam - 1.0 m; length - 5 (for each column). Material - titanium.
20. Washing of the ionite is carried out by water. Water consumption - 300 $m^3$/yr.
Washing water together with the solution are directed to iron extraction.
21. Extraction degree during the operation is, %:
Pt - 92.31; Pd - 96.85; Rh - 97.8; Au, Ru, Ir - 98.0.
22. Desorption of ionite is conducted with thiourea (C = 60 g($dm^3$) at 80° C.
Thiourea consumption for this operation is 600 $m^3$/y (losses by decomposition - 25%).
23. Washing of the ionite after desorption is carried out with water in the amount of 200 $m^3$/yr.
Eluate (in the amount of 800 $m^3$/y) is sent to the PGMs precipitation, while washed ionite is recycled to sorption.
24. The PGMs precipitation is carried out in reactors equipped with Stirrers. The PGMs solution is mixed with caustic solution.

PART 4

Eluate composition, g/$dm^3$:
Pt - 1862; Pd- 915; Rh - 15.1; Au- 2.15; Ru - 42.9; Ir - 0.516.
25. The PGMs are extracted from eluate solution by hydrolysis at ambient temperature and pH value of 11 adjusted by feeding of NaOH.
NaOH consumption is 5 t/y.
Eluate containing the PGMs is mixed with NaOH and maintained for 0.5 hour in reactor, then, while being maintained in a thickener for 20 hours, solid PGMs compounds are generating.
26. A 2.5-in diam pulp thickener is required to concentrate the PGMs slurry.
The PGMs slurry filtration rate is 0.2 $m^3/m^2$* hour. Filtering area - 5$m^2$.
27. The PGMs concentrate in the amount of - 3 400 kg/y, containing, %:
Pt - 43.8; Pd- 21.5; Rh - 3.55; Au- 0.5; Ru - 10.0; Ir- 0.12; S - 9.7; OH - 10.3,
is processed with selective extraction of PGMs into a commercial product by the known methods.
28. Thiourea solution in the amount of 600 $m^3$/y is mixed with hydrochloric acid (HCl consumption - 2.6 t/y) and recycled for desorption, while the solution in the amount of 200 $m^3$/y is evaporated with the following recycling of the condensate (–200 $m^3$/yr) for the ionite washing and removal of the generated salts to deposit area for disposal.
29. The solution (in the amount of 23 300 $m^3$/y) containing, in mg/$dm^3$:
Ni - 223; Cu - 51.52; Fe - 1888; Al - .1115; Ca - 1740; Pt - 4.92; Pd, Rh, Ru, Au < 1.0 is directed to iron extraction.
30. The iron extraction is conducted by tertiary amines in kerosene (0.8M).
Extraction is accomplished in 5 steps, stripping. - in 5.
Working volume of an extractor is - 6$m^3$. The materials - titanium, plastic.
An organic-to-aqueous volume ratio (O:A) is 1:10 for extraction and 3:1 for stripping.
31. After extraction, 3.5 N-solution of HCl is directed to leaching (15 000$m^3$/yr) and residue washing (10 000 $m^3$/y). The solution directed to washing is mixed with hydrochloric acid (HCl consumption - 217 t/y)
32. Stripping of iron is conducted by water.
$H_2O$ consumption is 700 $m^3$/y. Organic phase is recycled for iron extraction while iron-stripped solution is directed to iron precipitation.
33. The iron-stripped solution (in the amount of 700 $m^3$) contains, in g/$dm^3$:
Fe - 62.6; Ni - 7.42; Cu - 1.7; Al - 36.95; Ca - 57.9. The PGMs do not pass into solution and accumulate in organic phase, from which they are then stripped by 7 N HCl solution and directed to the PGMs sorption.
34. In order to remove Fe, Ni, Cu and other elements from the scheme, the stripped solution is processed by sodium carbonate and then discharged as slurry into the deposit area.
Process parameters:
Temperature - 80–90° C.
Duration - 2 hours
pH value - 11
$Na_2CO_3$ consumption - 250 t/y.

It will be appreciated that the embodiments of the invention which are described above with reference to the accompanying drawings are merely illustrative of ways of putting the invention into effect and should not be seen as limiting on the overall scope of the invention.

What is claimed is:

1. A hydrometallurgical treatment process for extracting platinum group metals from a flotation concentrate comprising the steps of:

leaching the flotation concentrate to dissolve base metal sulphides in the flotation concentrate and forming a filtrate and a residue;

separating the filtrate from the residue;

roasting the residue to form a calcine; and chlorinating the calcine to dissolve the platinum group metals into solution.

2. A hydrometallurgical treatment process according to claim 1 including the steps of:

adsorbing the platinum group metals onto an ion exchange resin; and recovering the platinum group metals from the ion exchange resin.

3. A hydrometallurgical treatment process according to claim 1, wherein the roasting step comprises oxidation or reduction of the residue.

4. A hydrometallurgical treatment process according to claim 3, wherein the oxidation takes place at a temperature of up to 1000° C.

5. A hydrometallurgical treatment process according to claim 1, wherein the process includes the step of recovering osmium from an off-gas from the roasting step.

6. A hydrometallurgical treatment process according to claim 1, wherein the chlorination step comprises counter-current chlorination of the calcine at approximately 80° C. and 3.5N HCl.

7. A hydrometallurgical treatment process according to claim 1, wherein the separation step comprises filtration followed by the additional steps of neutralisation of the filtrate; precipitation of base metal sulphides and flotation of precipitated sulphides into a concentrate.

8. A hydrometallurgical treatment process according to claim 2, wherein adsorption of the platinum group metals onto the ion exchange resin is followed by:

desorption of the platinum group metals from the resin with thiourea at approximately 80° C. to form a stripped resin and an eluate, followed by water washing of the stripped resin.

9. A hydrometallurgical treatment process according to claim 8, wherein the process includes the steps of:

precipitating the platinum group metals from the eluate with caustic solution.

10. A hydrometallurgical treatment process according to claim 1, wherein said leaching step comprises leaching a slurry of said flotation concentrate under pressure in an oxygen atmosphere in an autoclave.

11. A hydrometallurgical treatment process according to claim 1, wherein said process is in the absence of matte smelting of the flotation concentrate.

12. A hydrometallurgical treatment process according to claim 1, wherein said chlorinating step comprises chlorinating said calcine in the presence of HCl and chlorine to dissolve said platinum group metals into solution.

13. A hydrometallurgical treatment process according to claim 1, wherein said chlorinating step is an aqueous phase chlorination and converts said platinum group metals to soluble platinum group metal compounds, and dissolving said platinum group metal compounds.

14. A hydrometallurgical treatment process according to claim 1, wherein said roasting step comprises an oxidation roasting step.

* * * * *